US008917180B2

(12) United States Patent
Sayegh et al.

(10) Patent No.: US 8,917,180 B2
(45) Date of Patent: Dec. 23, 2014

(54) THEFT DETERRENT TAG

(75) Inventors: Adel O. Sayegh, Rancho Cucamonga, CA (US); Steve Gutierrez, Fontana, CA (US); Edgardo Redublo, Chino Hills, CA (US); Janki Bhalodia, Victorville, CA (US)

(73) Assignee: Universal Surveillance Corporation, Rancho Cucamonga, CA (US)

( * ) Notice: Subject to any disclaimer, the term of this patent is extended or adjusted under 35 U.S.C. 154(b) by 14 days.

(21) Appl. No.: 13/487,054

(22) Filed: Jun. 1, 2012

(65) Prior Publication Data

US 2012/0304710 A1 Dec. 6, 2012

Related U.S. Application Data

(60) Provisional application No. 61/492,090, filed on Jun. 1, 2011.

(51) Int. Cl.

| | |
|---|---|
| ***G08B 13/14*** | (2006.01) |
| ***E05B 73/00*** | (2006.01) |
| *E05B 45/00* | (2006.01) |
| *G08B 13/24* | (2006.01) |

(52) U.S. Cl.

CPC ..... *E05B 73/0029* (2013.01); *E05B 45/005* (2013.01); *G08B 13/2434* (2013.01)

USPC ..... 340/572.9; 70/57.1

(58) Field of Classification Search

CPC ..... E05B 73/0005; E05B 73/0017; E05B 73/0052; G08B 13/1463; G08B 13/2434; G06K 19/07749–19/07767

USPC ..... 340/10.1–10.52, 568.1–572.9; 70/57.1

See application file for complete search history.

(56) References Cited

U.S. PATENT DOCUMENTS

| | | | |
|---|---|---|---|
| 639,196 | A | 12/1899 | Fehling |
| 673,612 | A | 5/1901 | Appleby |
| 886,905 | A | 5/1908 | Ward |
| 895,403 | A | 8/1908 | Jackson |
| 1,083,612 | A | 1/1914 | Hooker |
| 1,124,130 | A | 1/1915 | Grant |
| 1,141,245 | A | 6/1915 | Gillespie |
| 1,165,320 | A | 12/1915 | Clary |
| 1,165,816 | A | 12/1915 | Tichenor |
| 1,657,190 | A | 1/1928 | Ballou |
| 1,992,868 | A | 2/1935 | Krause |
| 2,002,946 | A | 5/1935 | Jacobs |
| 2,574,967 | A | 11/1951 | Gossner et al. |
| 3,395,555 | A | 8/1968 | Hickman |
| 3,397,849 | A | 8/1968 | Hansen |
| 3,466,668 | A | 9/1969 | Ochiai |
| 3,568,902 | A | 3/1971 | Highberger |

(Continued)

FOREIGN PATENT DOCUMENTS

| | | | | |
|---|---|---|---|---|
| WO | WO 94/08115 | A1 * | 4/1994 | ..... E05B 73/00 |
| WO | WO 00/32487 | A1 * | 6/2000 | ..... B65D 33/34 |
| WO | WO 2005/001787 | A1 * | 1/2005 | ..... G08B 13/14 |

*Primary Examiner* — Hai Phan
*Assistant Examiner* — Orlando Bousono
(74) *Attorney, Agent, or Firm* — Milord A. Keshishian

(57) ABSTRACT

The present invention discloses an EAS based theft-deterrent tag, comprising a main member coupled with an article by a coupling mechanism. The coupling mechanism is configured to allow comfortable trial of the article prior to purchasing, without detachment and removal of the theft deterrent tag from the article.

25 Claims, 18 Drawing Sheets

(56) References Cited

U.S. PATENT DOCUMENTS

| | | | | | |
|---|---|---|---|---|---|
| 3,611,760 | A | | 10/1971 | Muther | |
| 3,831,407 | A | | 8/1974 | Coleman | |
| 3,906,758 | A | | 9/1975 | Hurwitt | |
| 3,929,300 | A | | 12/1975 | Lindqvist | |
| 4,004,440 | A | | 1/1977 | Dreyer | |
| 4,071,023 | A | | 1/1978 | Gregory | |
| 4,086,795 | A | | 5/1978 | Foster et al. | |
| 4,418,551 | A | | 12/1983 | Kochackis | |
| 4,665,724 | A | | 5/1987 | Sakai | |
| 4,756,171 | A | | 7/1988 | Homar | |
| 4,827,577 | A | | 5/1989 | Vaux | |
| 4,896,517 | A | | 1/1990 | Ling | |
| 4,930,324 | A | | 6/1990 | Meier | |
| 4,949,679 | A | | 8/1990 | Wolfer | |
| 5,140,836 | A | * | 8/1992 | Hogan et al. | 70/57.1 |
| 5,144,821 | A | | 9/1992 | Ernesti et al. | |
| 5,156,028 | A | | 10/1992 | Jiang | |
| 5,193,368 | A | | 3/1993 | Ling | |
| 5,345,947 | A | | 9/1994 | Fisher | |
| 5,379,496 | A | | 1/1995 | Krauss | |
| 5,517,836 | A | | 5/1996 | Hong | |
| 5,524,463 | A | * | 6/1996 | Schenkel et al. | 70/57.1 |
| 5,551,447 | A | | 9/1996 | Hoffman et al. | |
| 5,581,853 | A | | 12/1996 | Miller et al. | |
| 5,598,727 | A | | 2/1997 | White | |
| 5,610,587 | A | | 3/1997 | Fujiuchi et al. | |
| 5,647,106 | A | * | 7/1997 | Hogan | 24/704.1 |
| 5,671,506 | A | | 9/1997 | Eliasson | |
| 5,687,455 | A | | 11/1997 | Alexander | |
| 5,687,456 | A | | 11/1997 | Chang | |
| 5,722,266 | A | | 3/1998 | Yeager et al. | |
| 5,794,464 | A | | 8/1998 | Yeager et al. | |
| 5,832,752 | A | | 11/1998 | Zeller | |
| 5,856,782 | A | | 1/1999 | Sasagawa et al. | |
| 5,959,532 | A | | 9/1999 | Fujiuchi et al. | |
| 5,960,652 | A | | 10/1999 | Marmstad | |
| 6,040,764 | A | | 3/2000 | Crisci | |
| 6,092,401 | A | | 7/2000 | Sankey et al. | |
| 6,128,932 | A | | 10/2000 | Mainetti et al. | |
| 6,188,320 | B1 | | 2/2001 | Kolton et al. | |
| 6,237,375 | B1 | | 5/2001 | Wymer | |
| 6,404,341 | B1 | | 6/2002 | Reid | |
| 6,550,293 | B1 | | 4/2003 | Delegato et al. | |
| 6,681,603 | B1 | | 1/2004 | Yu | |
| D492,215 | S | | 6/2004 | Lu | |
| 6,755,055 | B2 | | 6/2004 | Sedon et al. | |
| 7,129,841 | B2 | | 10/2006 | Feibelman | |
| 7,162,899 | B2 | | 1/2007 | Fawcett et al. | |
| 7,168,275 | B2 | | 1/2007 | Fawcett et al. | |
| D543,590 | S | | 5/2007 | Feibelman | |
| 7,221,274 | B2 | | 5/2007 | Fawcett et al. | |
| 7,227,467 | B2 | | 6/2007 | Feibelman | |
| 7,251,966 | B2 | | 8/2007 | Fawcett et al. | |
| 7,272,962 | B2 | | 9/2007 | Benda et al. | |
| 7,481,086 | B2 | | 1/2009 | Fawcett et al. | |
| 7,518,521 | B2 | | 4/2009 | Feibelman et al. | |
| 7,626,501 | B2 | | 12/2009 | Feibelman | |
| 2003/0182763 | A1 | | 10/2003 | Jeffries | |
| 2005/0270155 | A1 | * | 12/2005 | Sayegh | 340/572.1 |
| 2006/0220848 | A1 | | 10/2006 | Tropper | |
| 2007/0012772 | A1 | | 1/2007 | Cooper | |
| 2008/0157979 | A1 | * | 7/2008 | Sayegh | 340/572.8 |
| 2008/0165014 | A1 | * | 7/2008 | Sayegh | 340/572.9 |
| 2008/0284601 | A1 | * | 11/2008 | Sayegh et al. | 340/572.1 |
| 2009/0033497 | A1 | * | 2/2009 | Wyatt et al. | 340/572.1 |
| 2010/0060455 | A1 | * | 3/2010 | Frabasile | 340/572.4 |
| 2010/0101283 | A1 | | 4/2010 | Xiaobin | |
| 2010/0103025 | A1 | * | 4/2010 | Schantz et al. | 342/174 |
| 2010/0315237 | A1 | * | 12/2010 | Yang | 340/572.8 |
| 2011/0283754 | A1 | * | 11/2011 | Ezzo et al. | 70/57.1 |
| 2012/0285206 | A1 | * | 11/2012 | Favier | 70/19 |

* cited by examiner

Power
501
VCC
R10
VDD
C6
S1
CON 2
2
1
C7
L2
Optional
Ferrite Coil
502N
732
R7
C5
D1
124
X1
R8
C4
Vss
Xin
Xout
TSET
RST
A7
A6
Vcc
A0
A1
A2
A3
A4
A5
MICROPROCESSOR
626
740
U1
T2
VDD
Q3
R9
752
CON 3
TSET
RST
758
790
C3
R30
R5
714
S3
780
S2
To reel
mechanism
116
112
502a
CON12
CON11
C2
L1
Ferrite Coil (Antenna)
Z10
Q1
716
R2
C1
R1
CON 1

THEFT DETERRENT TAG

CROSS-REFERENCE TO RELATED APPLICATIONS

This application claims the benefit of priority of U.S. Provisional Utility Patent Application No. 61/492,090, filed Jun. 1, 2011, the entire disclosure of which is expressly incorporated by reference herein.

BACKGROUND OF THE INVENTION

1. Field of the Invention

This invention relates to theft deterrent security tags in general, and in particular to Electronic Article Surveillance (EAS) security tags that are coupled with articles without altering or damaging the article.

2. Description of Related Art

It is a common practice for retail stores to tag articles to prevent theft of the article by shoplifters. There are several methods of tagging articles, most common of which are coupling an EAS tag or markers (e.g., EAS labels) using adhesive, pins, lanyards or straps to trigger the EAS security system resulting in an alarm. The label markers are easy to remove while the cables or strapped tags are sometimes bulky or obtrusive to the person handling the article, making product placement of the article inconvenient and marketing thereof ineffective. As to pin type EAS tags, they are coupled with an article by the pin of the EAS tag puncturing the article, which may not be suitable or possible with most articles, such as shoes, skateboards, snowboards, framed art, etc.

Accordingly, there remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored without damaging or altering the article. Further, there also remains a long standing and continuing need for an advance in the art of EAS and theft deterrent tags that would enable a user to comfortably tryout or use an article for testing without the detachment or removal of the tag from the article.

BRIEF SUMMARY OF THE INVENTION

A non-liming, exemplary optional aspect of the present invention provides a theft-deterrent tag, comprising:

a main member coupled with an article by a coupling mechanism;

the coupling mechanism is configured to allow comfortable trial of the article without detachment and removal of the theft deterrent tag from the article.

Another non-liming, exemplary optional aspect of the present invention provides a theft-deterrent tag, comprising:

a main member that includes an alarm system is coupled with an article by a coupling mechanism;

the coupling mechanism is configured to allow comfortable trial of the article without detachment and removal of the theft deterrent tag from the article;

the coupling mechanism includes:

a first coupling element;

a second coupling element; and an adjustable piece that is looped around the article and manipulated for a tight engagement of the main member with the article connecting the first and the second coupling elements, with the adjustable piece comprised of a sense loop cable.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart (if a flowchart is used) may represent both method function(s), operation(s), or act(s) and one or more elements for performing the method function (s), operation(s), or act(s). In addition, depending upon the implementation, the corresponding one or more elements may be configured in hardware, software, firmware, or combinations thereof.

As illustrated in FIGS. 1A to 1G, the present invention provides a theft-deterrent tag 100 that is comprised of a main member 104 coupled with an article 102 by a coupling mechanism 110 and 112. The coupling mechanism 110 and 112 is configured to allow comfortable trial of the article 102 without detachment and removal of the theft deterrent tag 100 from the article 102. That is, the present invention enables the comfortable trying on of the article 102 such as a shoe without the interference of the tag 100 (i.e., the tag 100 does not obstruct or is not in the way of potential buyers' feet when they try on the shoes). Element 128 represents one or more external transponders.

Figure 1A:
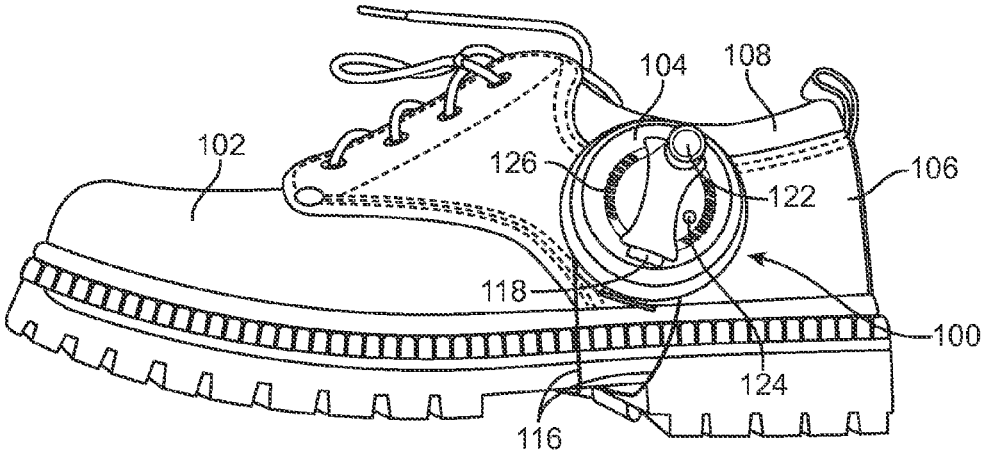
FIGS. 1A to 1J are non-limiting, exemplary illustrations of various views of an EAS tag associated with exemplary articles in accordance with the present invention.
Figure 1B:
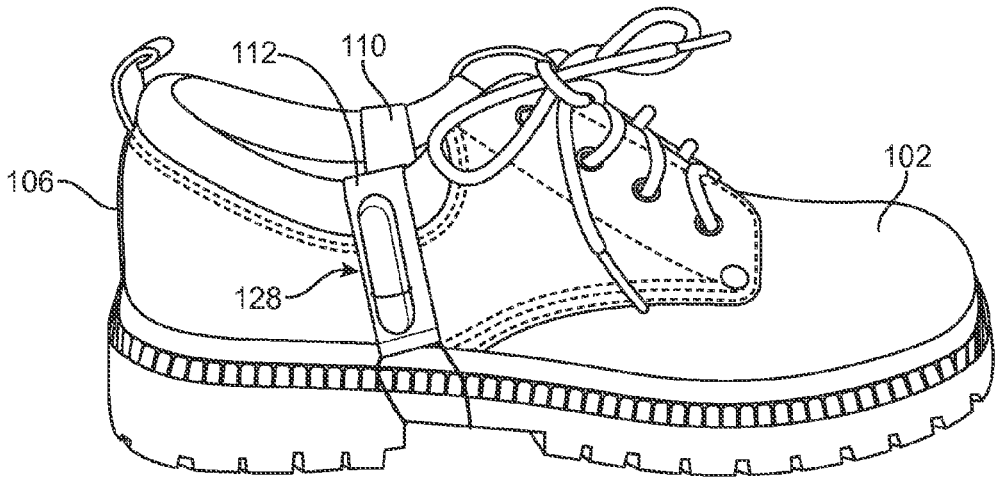
Figure 1C:
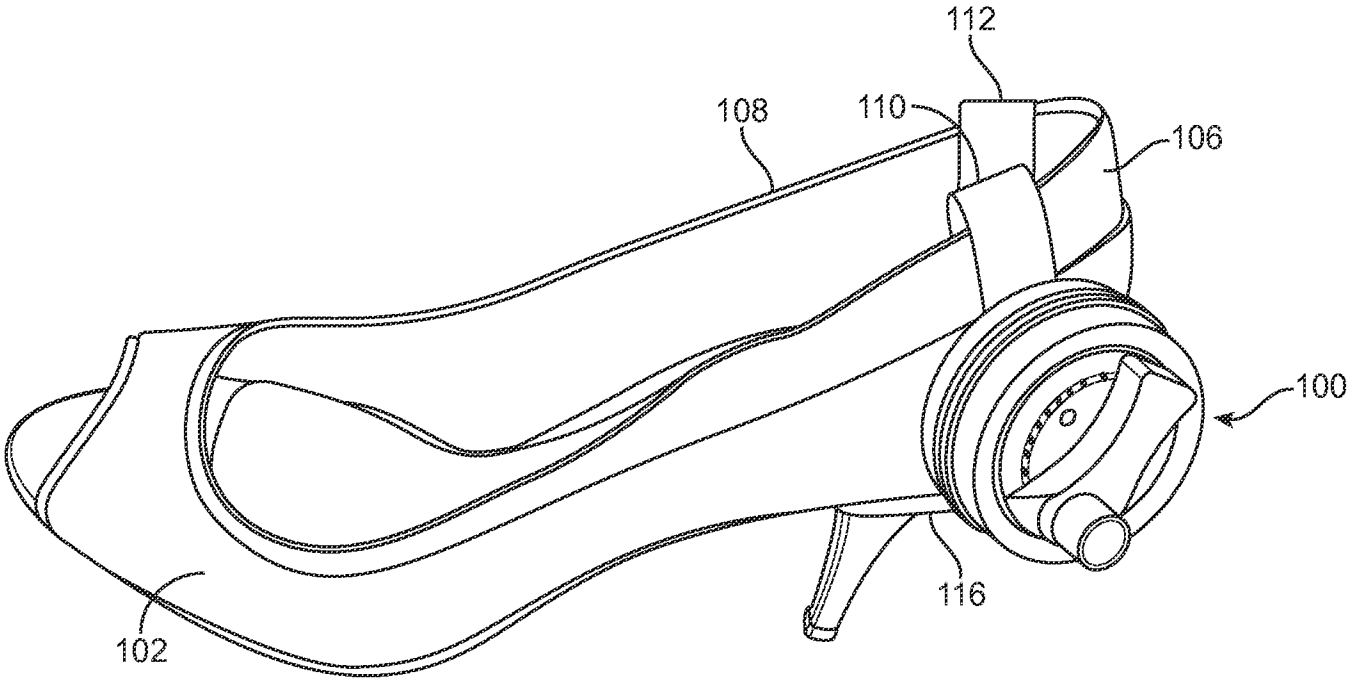
Figure 1D:
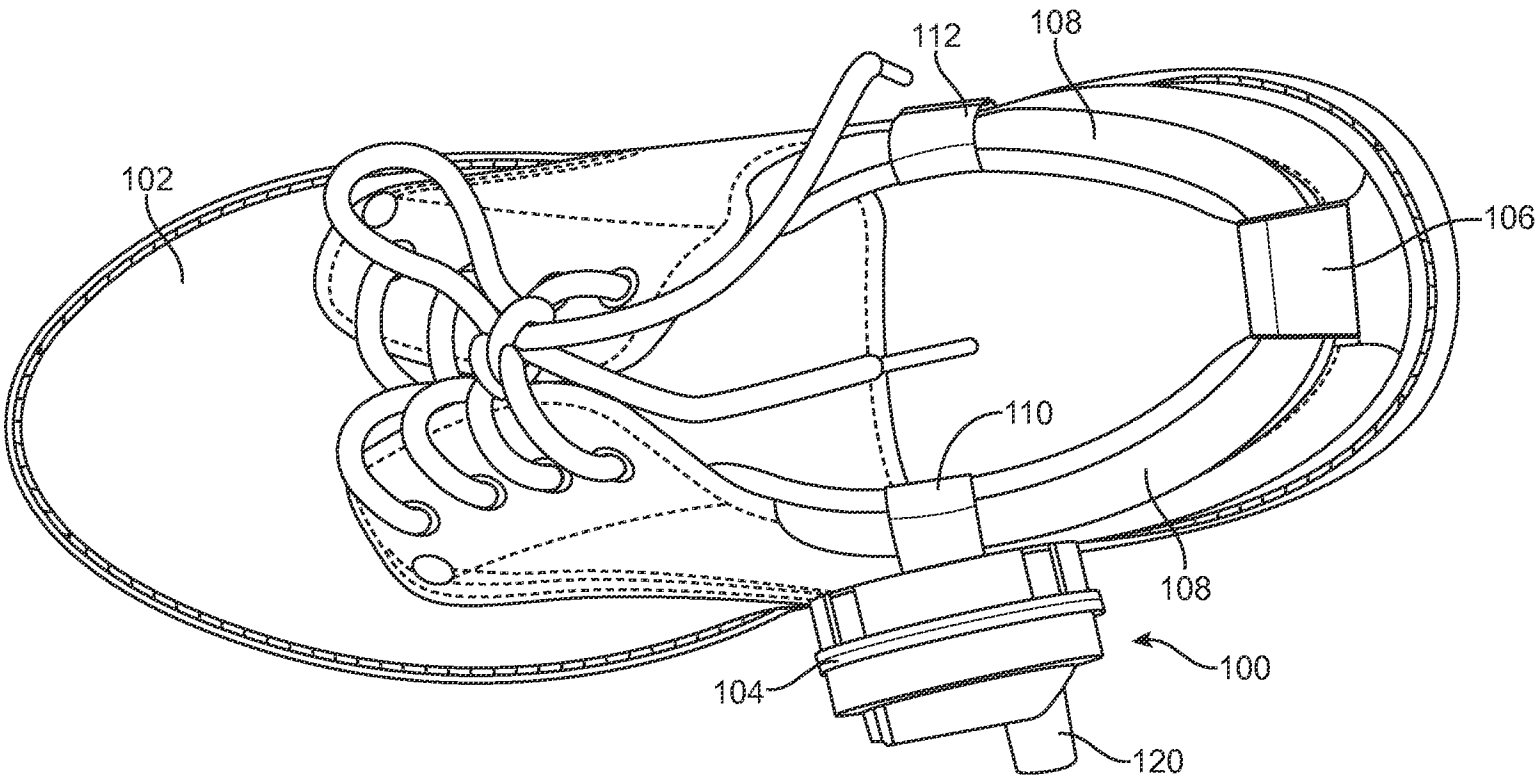
Figure 1E:
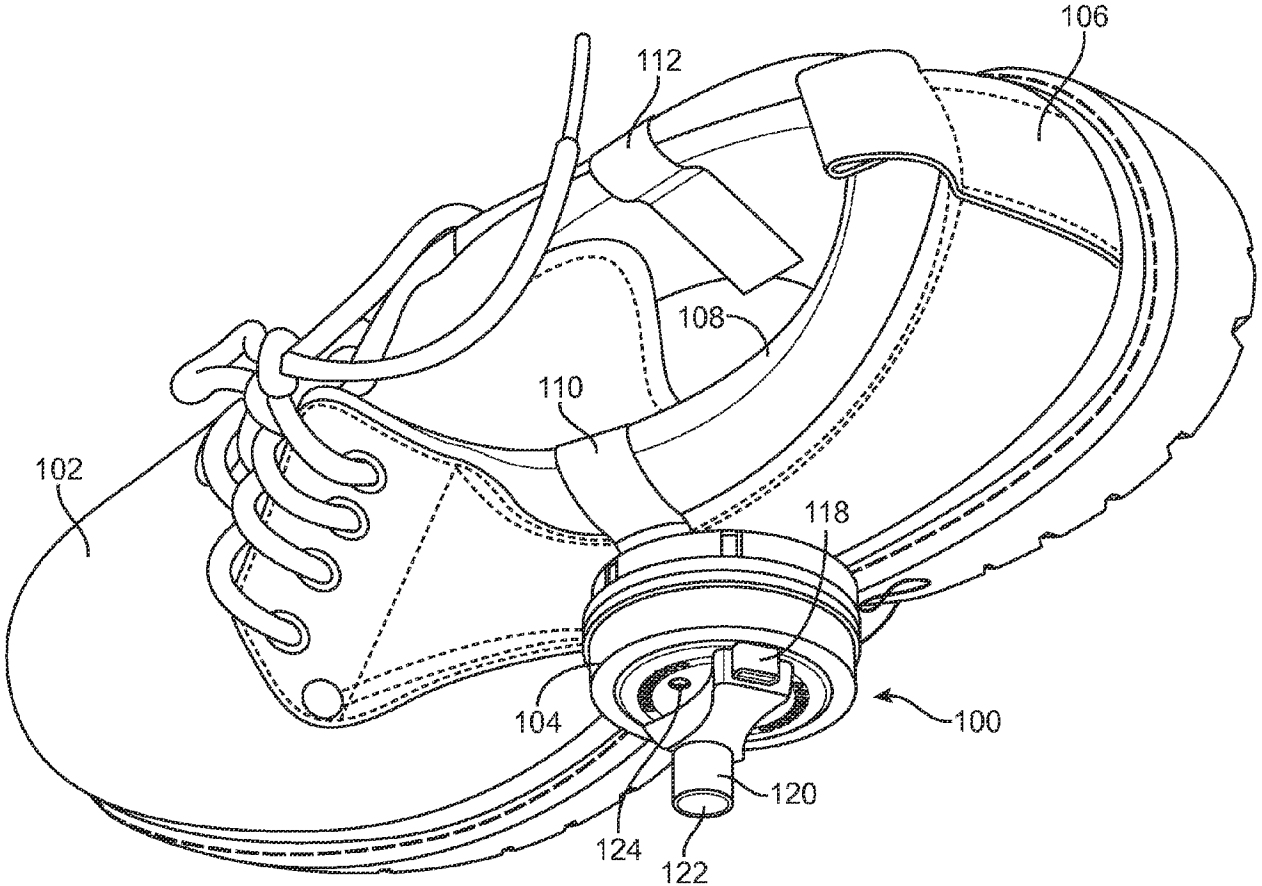
Figure 1G:
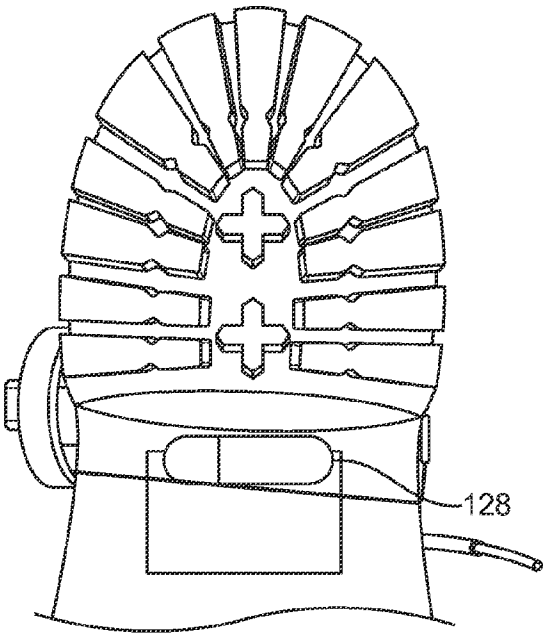
Figure 1F:
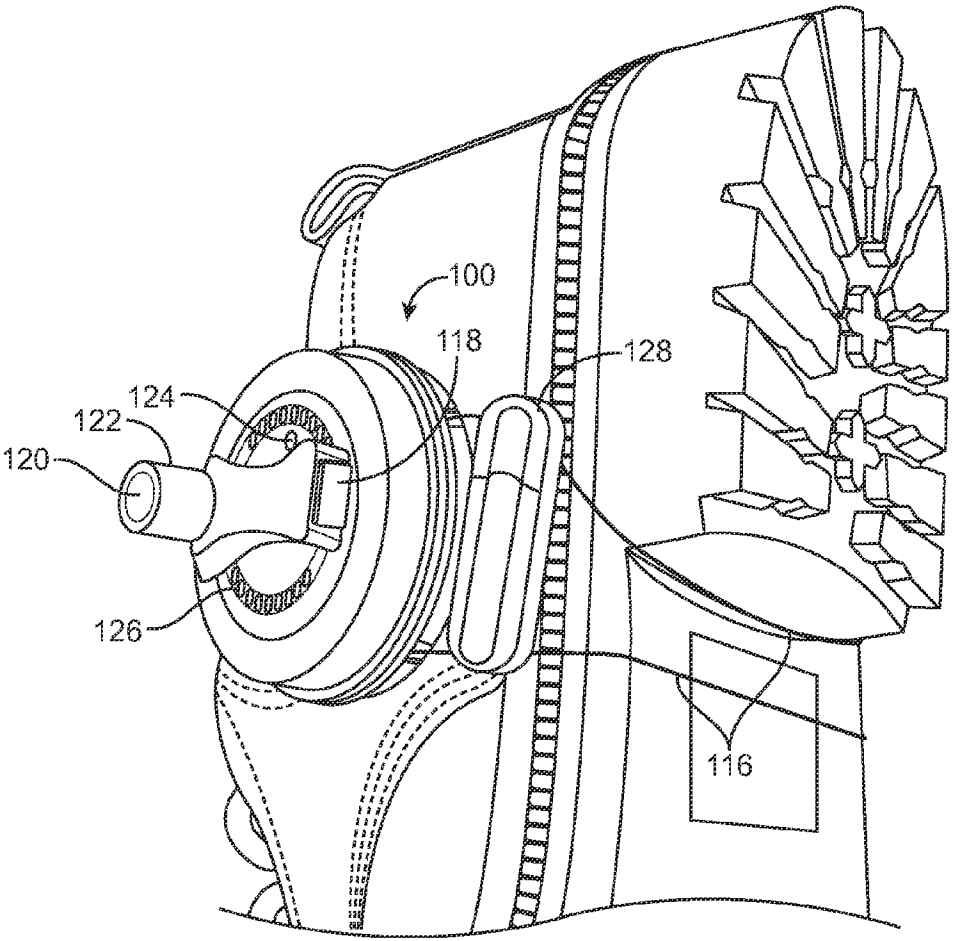
Figure 1H:
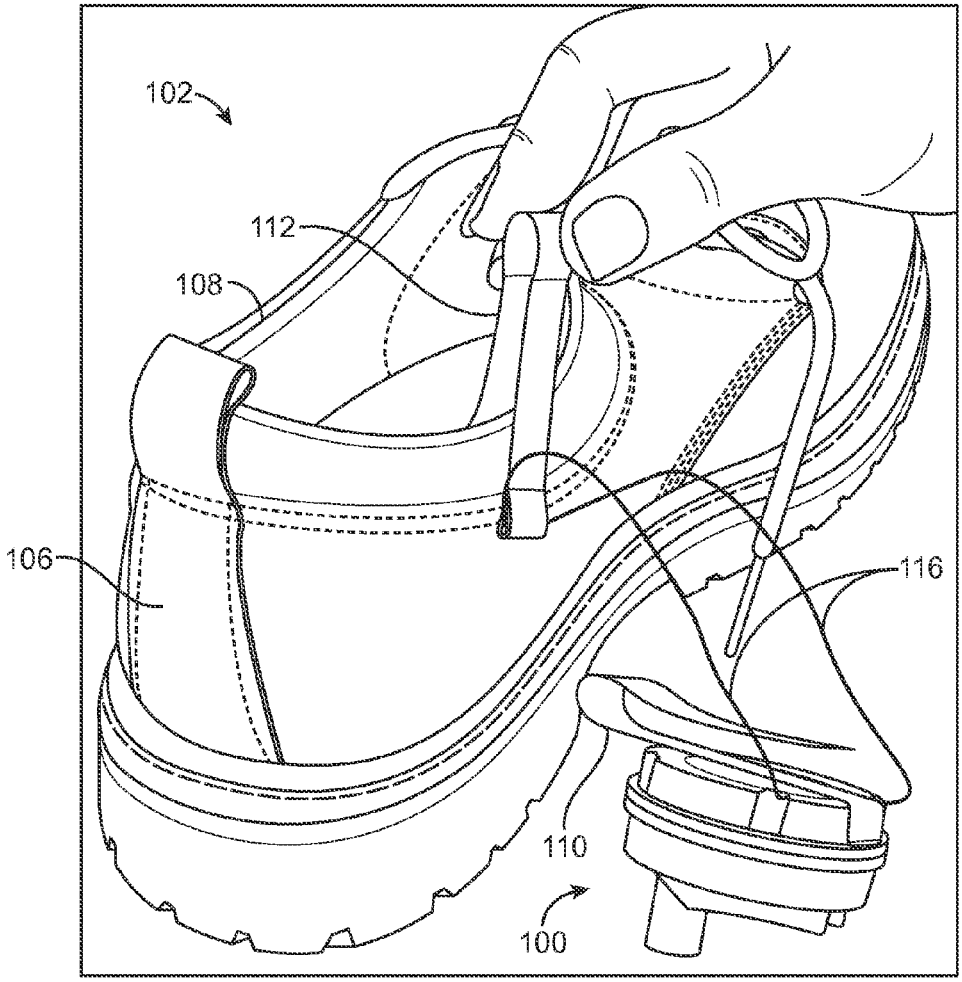
Figure 1I:
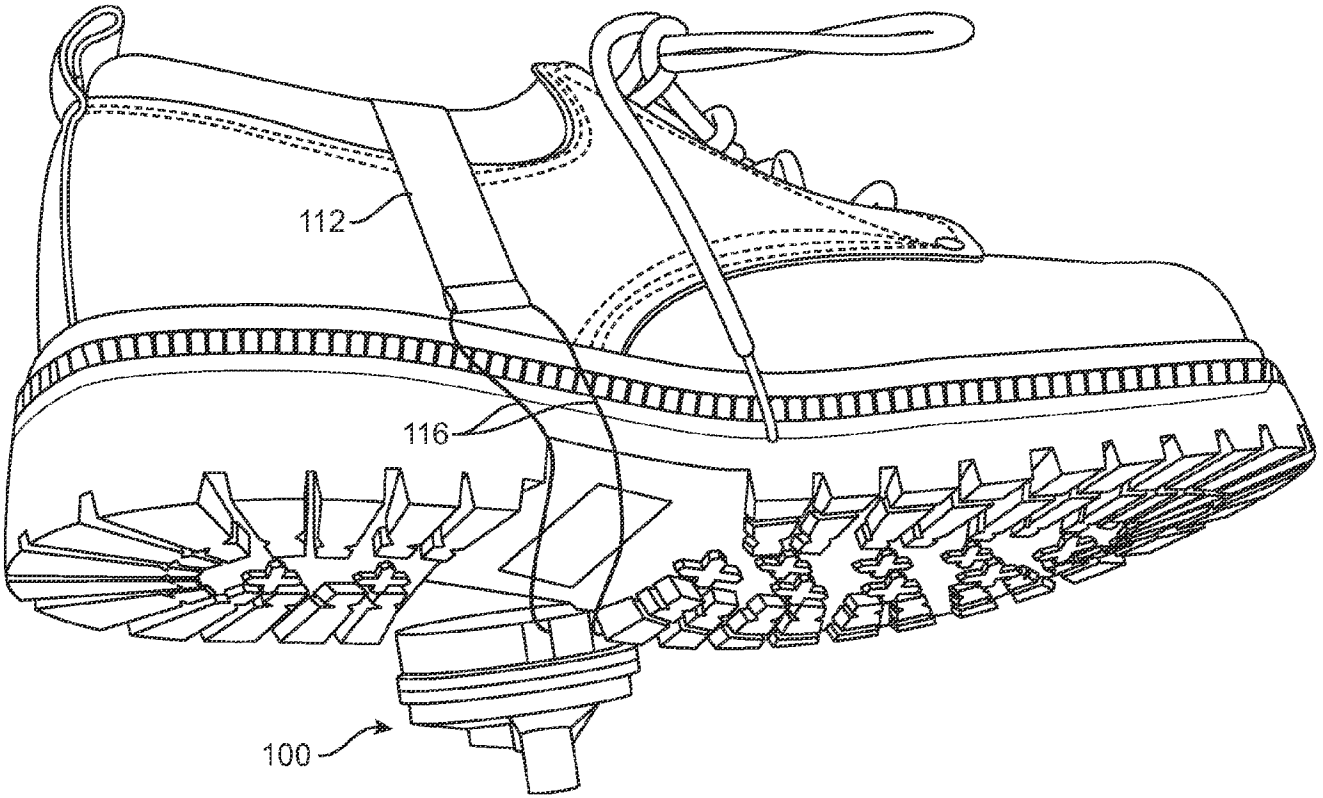
Figure 1J:
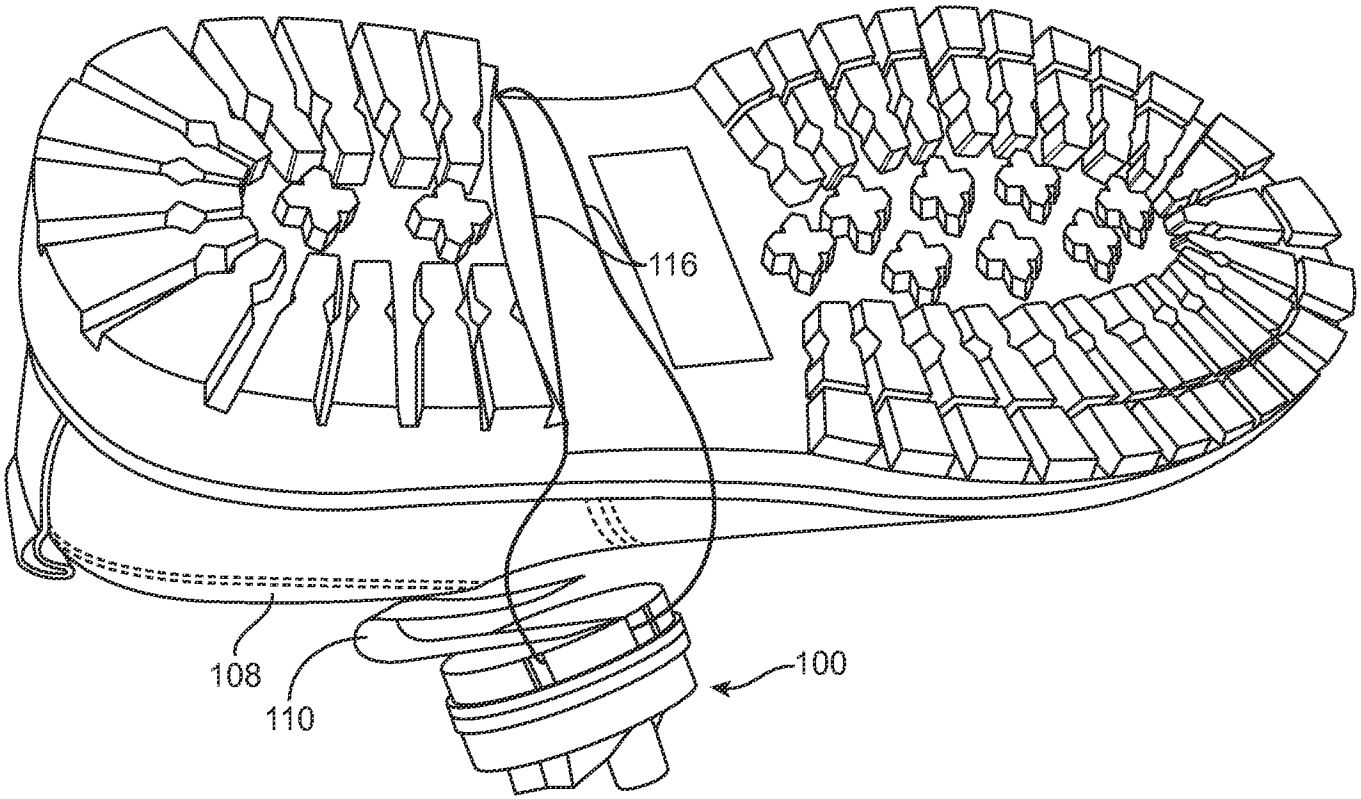

As best illustrated in the FIGS. 1H to 1J, the tag 100 may be detachably mounted onto the quarter 108 sections of the shoe 102 (generally, near the counter section 106), enabling free, easy, unobstructed insertion of the feet of potential buyers when trying on the shoes. The method for detachably mounting the theft-deterrent tag 100 onto an article 102 includes positioning one of the first and the second coupling mechanisms 110 and 112 onto a first quarter section of the shoe. Further, maneuvering the theft-deterrent tag 100 from underneath the outsole of the shoe, and positioning the other of the second and first coupling mechanism 112 and 110 onto a second quarter section of the shoe. The arrangement enables an adjustable piece 116 that adjustably couples the first coupling mechanism 110 of the main member 104 with the second coupling mechanism 112 to be routed via the outsole of the shoe rather than from a top of the insole. Routing the adjustable piece along the outsole is beneficial in that the adjustable piece will not obstruct the insole (or be in the way thereof), enabling easy insertion of the feet of a potential buyers that wish to try out the shoe without removal of the tag 100. Upon coupling the first and second coupling mechanism 110 and 112 with respective quarter sections 108 of the shoe 102, a handle 120 of the main member 104 is rotated to reel-in and contract the adjustable piece 116, which decreases the separation span between the main member 104 and the second coupling mechanism 112. The contraction of the adjustable piece 116 tightly secures with the theft-deterrent tag 100 onto the article 102. As illustrated, the small, thin (but sturdy and strong) form of the coupling mechanism 110 and 112 enables secure engagement of the theft-deterrent tag 100 with the article 102, but without the tag 100 interfering with the pleasant experience of potential buyers trying on the product. That is, coupling mechanisms 110/112 are comprised of a strong material (e.g., metal) that is rigid with certain level of resilience to enable the coupling mechanism to be coupled with an article, and it includes insulation to protect the article surface with which the tag is coupled. There are numerous methods of implementing the coupling mechanism, non-limiting, non-exhaustive listing of examples of which may include, for example, fasteners such as a clip or a clamp that is shown in the figures.

Figure 2A:
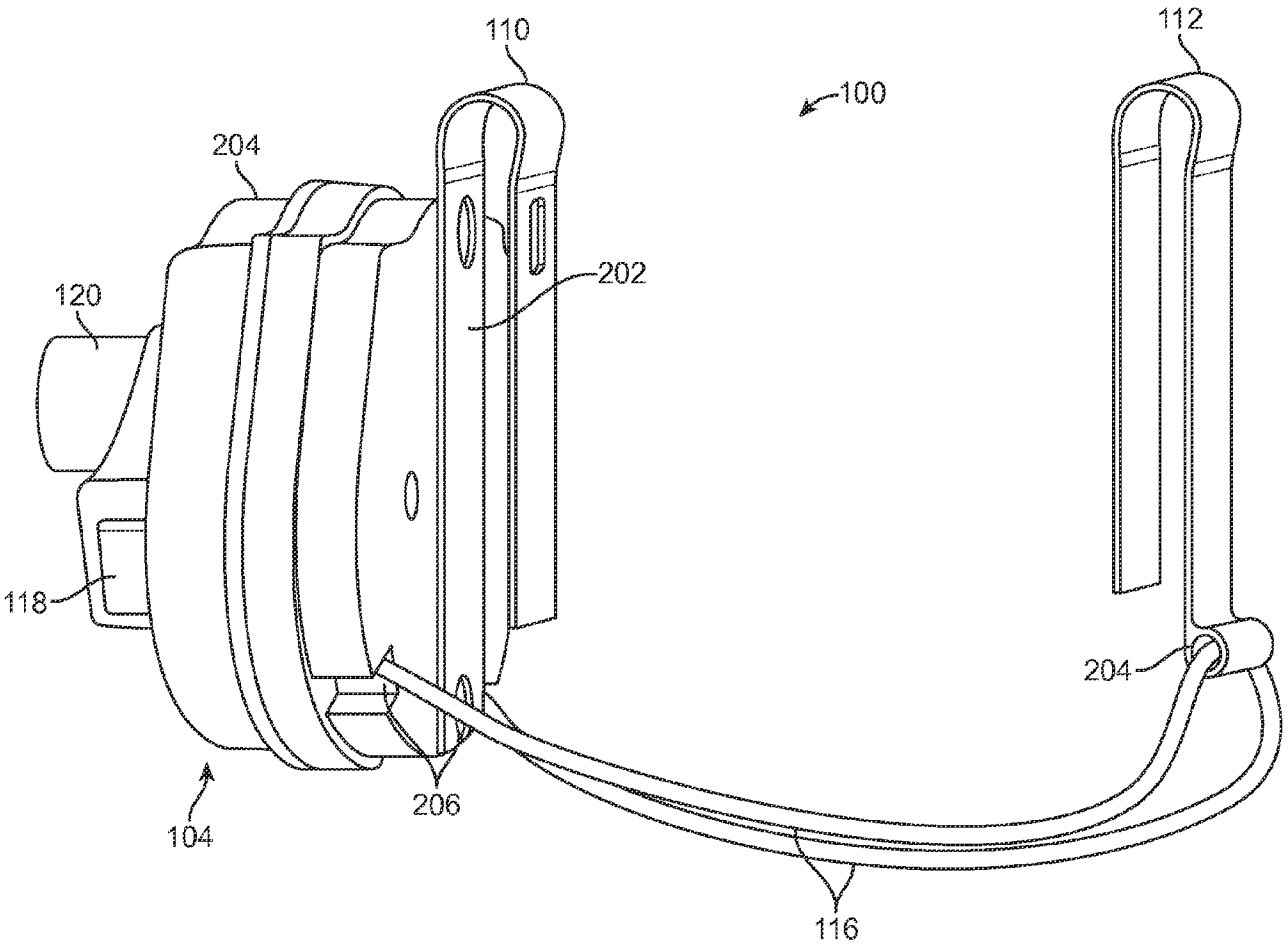
FIGS. 2A to 2C are non-limiting, exemplary illustration of the theft-deterrent tag illustrated in FIGS. 1A to 1J in accordance with the present invention, but without the article.
Figure 2B:
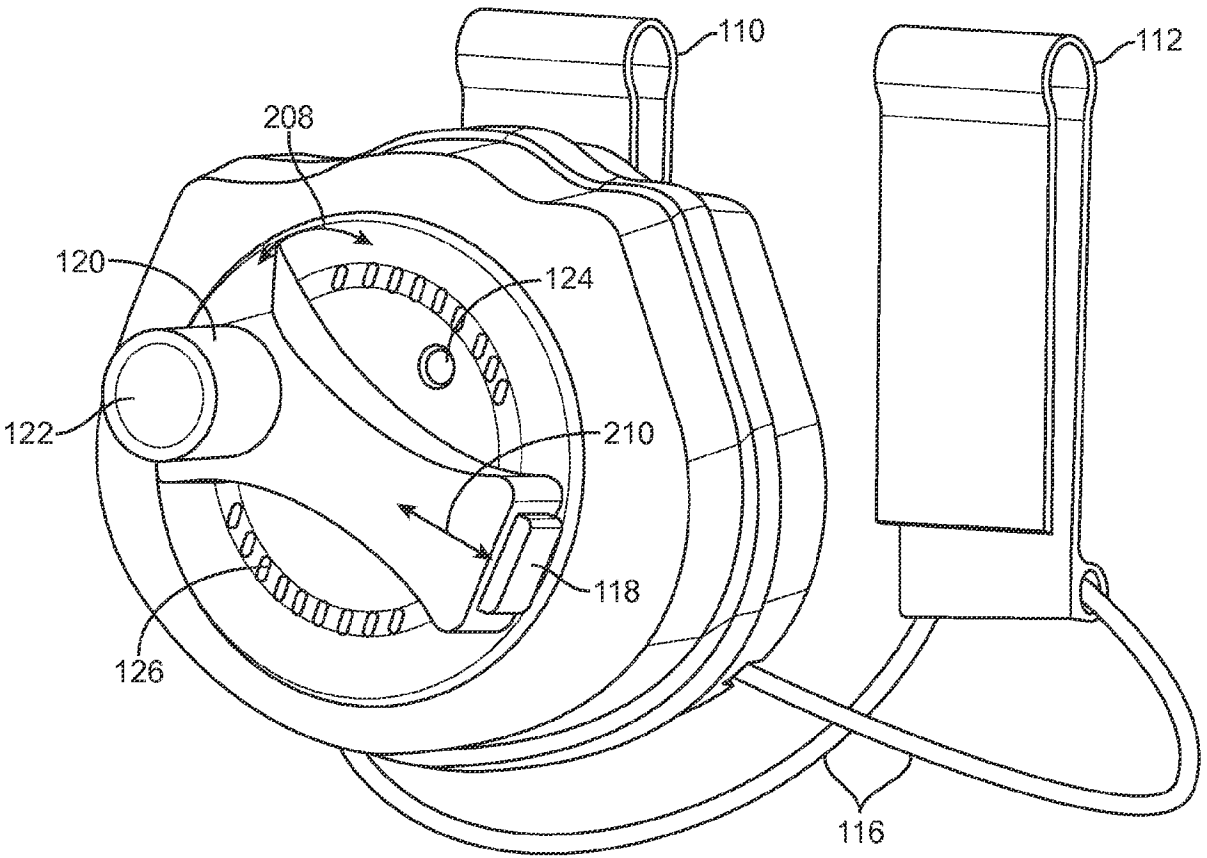
Figure 2C:
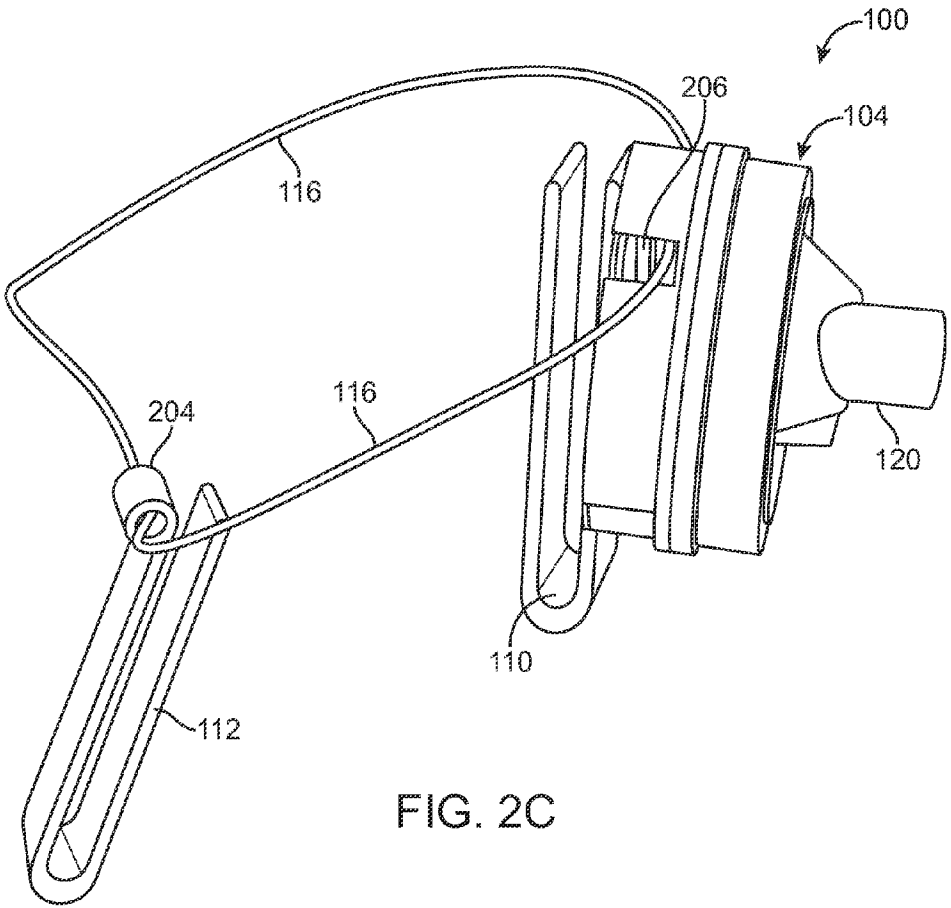

FIGS. 2A to 2C are non-limiting, exemplary illustration of the theft-deterrent tag illustrated in FIGS. 1A to 1J in accordance with the present invention, but without the article. As illustrated, theft-deterrent tag 100 is comprised of the main member 104 that includes the first coupling mechanism 110 that is permanently attached and connected to the main member 104, enabling the theft-deterrent tag 100 to be detachably secured with the article 102 for the detection of the article 102. The first coupling mechanism 110 may be attached to the main member 104 by a variety of ways, non-limiting examples of which may include the use of fasteners such as screws, or may be welded or molded together with the main member 104. Further included is the second coupling mechanism 112 that is coupled with the main member 104 by an adjustable piece 116, which loops through a looping barrel 204 of the second coupling mechanism 112.

As detailed below, the main member 104 accommodates a reel or winder consisting of a revolving spool with a handle 120, an internal alarm system with a power source and electronics that constitute the theft-deterrent tag 100 as an EAS tag, and an alarm switch 202 that actuates upon securing the article within the coupling mechanism 110. The alarm switch 202 is actuated when a side of the article is pressed against the alarm switch 202, and the theft-deterrent tag 100 is tightly secured on the article 102.

As best illustrated in FIG. 2B, the main member housing includes the handle 120 that may be rotated along a reciprocating path 208 to extend or contract the adjustable piece 116 to adjust the distance between second coupling mechanism 112 and the main member 104 for a tight engagement of the tag 100 with the article 102. The main member 104 housing further includes a visual indicator aperture for accommodating a visual indicator such as a Light Emitter Diode (LED) 124 that is used to indicate if the internal alarm system is set or active, and perforated areas 126 that are openings for output of an audio indicator sound of the internal alarm system. Opposite the handle 120, the main member 104 includes a power switch actuator 118 that when reciprocated along path 210 turns ON/OFF a power switch plunger to supply power to the internal alarm system. The interior cavity or chamber of the handle 120 accommodates a clutch housing 122 that includes a clutch that functions to maintain the power switch actuator 118 to an ON position.

As best illustrated in FIGS. 2A and 2C, the adjustable piece 116 loops through the looping barrel 204 of the second coupling mechanism 112, with the first and the second ends of the adjustable piece 116 passed through the holes 206 of the main member 104, enabling the first and second ends of the adjustable piece 116 to respectively couple with the reel and internal alarm system housed in the main member 104.

Figure 3B:
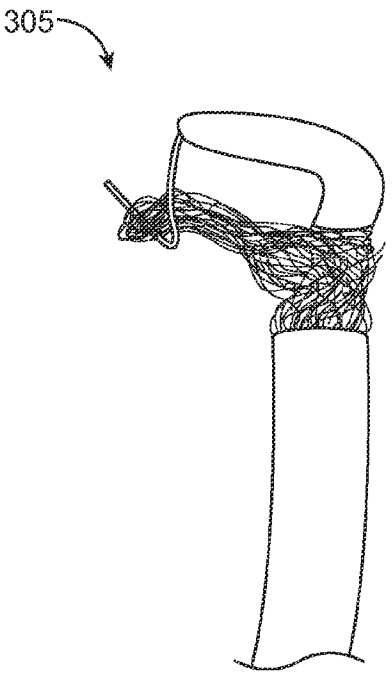
FIGS. 3A to 3C are non-limiting, exemplary illustrations of a cable sense loop of the theft-deterrent tag illustrated in FIGS. 1A to 2C.
Figure 3A:
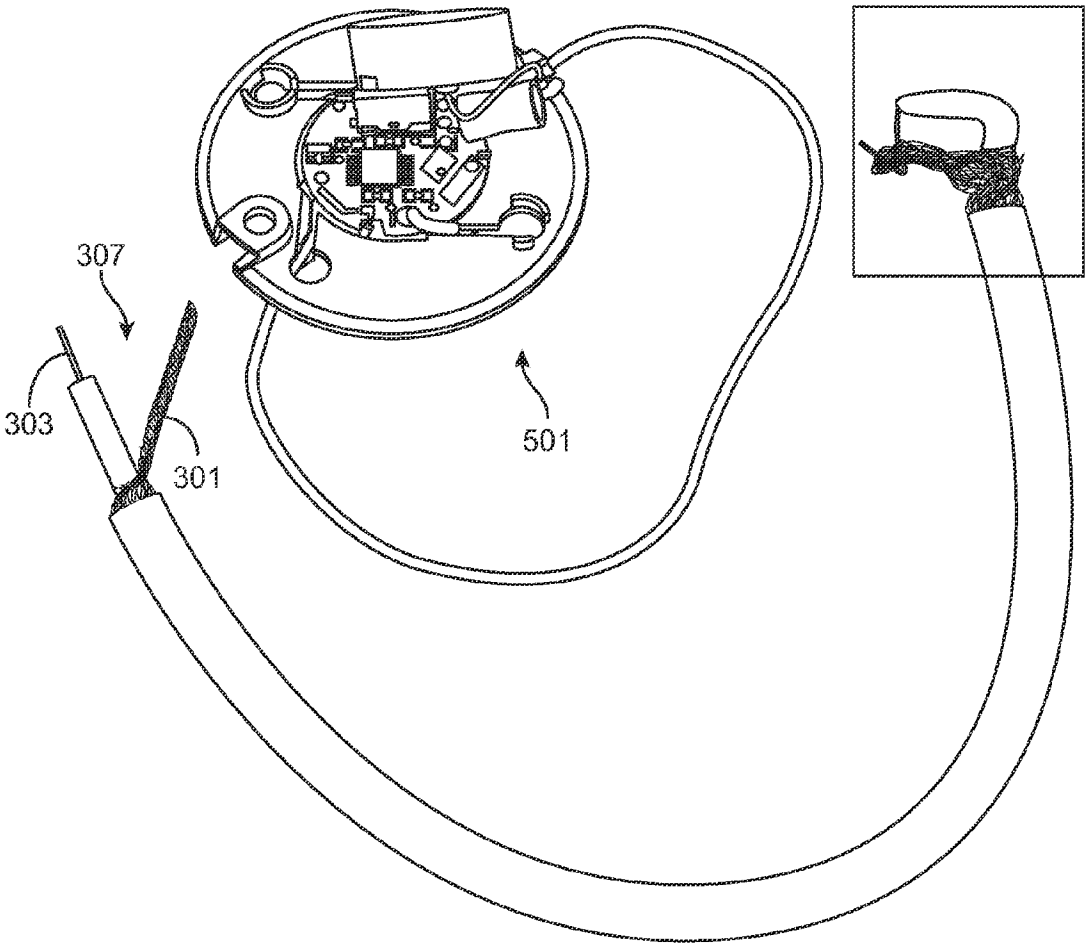
Figure 3C:
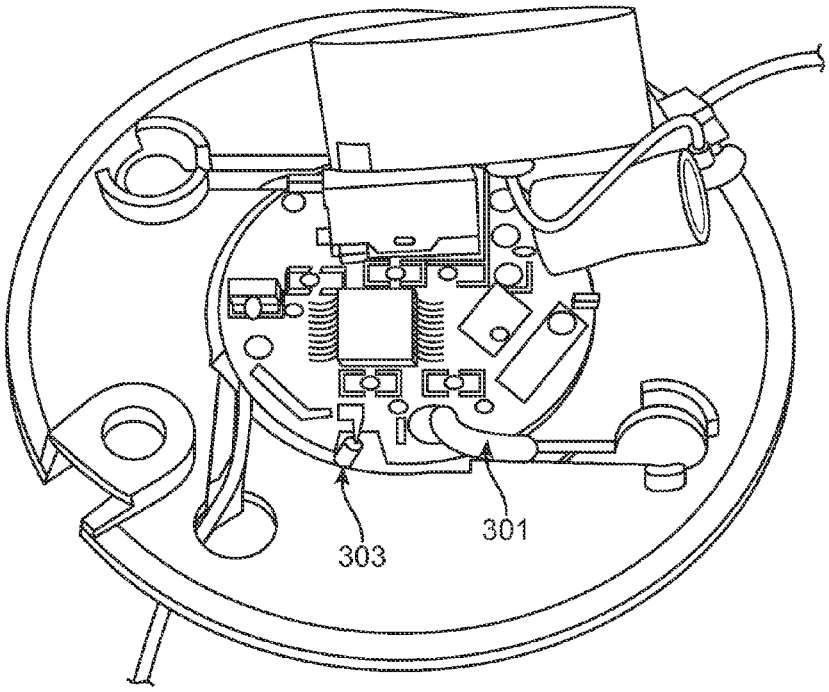

As best illustrated in FIGS. 3A to 3C, the adjustable piece 116 is comprised of at least one insulated conductor 303 within and inside a second conductor 301, with first ends 305 of both of the conductors mechanically and electrically connected together and coupled with the reel, and second ends 307 of both conductors connected with an alarm system of the theft-deterrent tag 100, forming an electrically closed circuit. With the adjustable piece 116 of the present invention, if severed, the use of jumper cables will maintain the electrical circuit loop closed for the outer conductor 301 only, but not the insulated and hidden inner conductor 303 that is within and inside the insulated outer conductor 301. Therefore, when severing the adjustable piece 116 to disconnect and discontinue the physical loop to remove the secured article 102, even if jumper cables are used, the insulated inner conductor 303 will remain open circuited when the adjustable piece 116 is cut, resulting in trigger of an alarm. That is, the use of the jumper cables will form a closing contact between the severed ends of the outer conductor 301, but cannot contact the insulated and hidden inner conductor 303 that is severed.

As stated above, the adjustable piece 116 is comprised of one or more insulated inner conductors 303 enclosed within and inside one or more insulated outer conductors 301. The inner conductors 303 are longitudinally insulated from one another and from the insulated outer conductors 301 by one or more inner dielectric layers. A transparent outer dielectric layer further longitudinally insulates the outermost outer conductor. In other words, all conductors are independently insulated from one another. The first distal end of the adjustable piece 116 is generally encapsulated and is comprised of short-circuited first ends 305 of the inner and outer conductors, with the short-circuited encapsulating first ends coupled with the reel of the main member 104. That is, the first end 305 of the inner conductors 303 are mechanically and electrically connected ("pinched" together) with the first end of the outer conductors, forming a short-circuited return wire, and encapsulated and coupled with the reel.

The second distal end 307 of the adjustable piece 116 is comprised of second ends of the inner and outer conductors 303 and 301, which are coupled to printed circuit board of the internal alarm system housed with the main member 104, resulting in a sense loop cable. As further illustrated (in FIGS. 3A to 3C), the second distal end further includes a conductive connector that secures the inner and outer conductors, and securely maintains an extension of the outer conductors 301. The inner and outer conductors (and extension) are coupled with ground GND and an input of a microprocessor. At least one of the conductors (in this exemplary instance the outer conductors) may be an internal spirally-wrapped electrical conductive cord that is bulky and strong for added mechanical strength to secure an article. Accordingly, the extension (electrically and mechanical connected with the bulky outer conductor via the conductive connector) is used as the extension of the conductor so to fit inside the housing 104 of the theft-deterrent tag 100, and allow outer conductor to mechanically and electrically connected with the electronics of the tag 100 via the less bulky extension.

Figure 4:
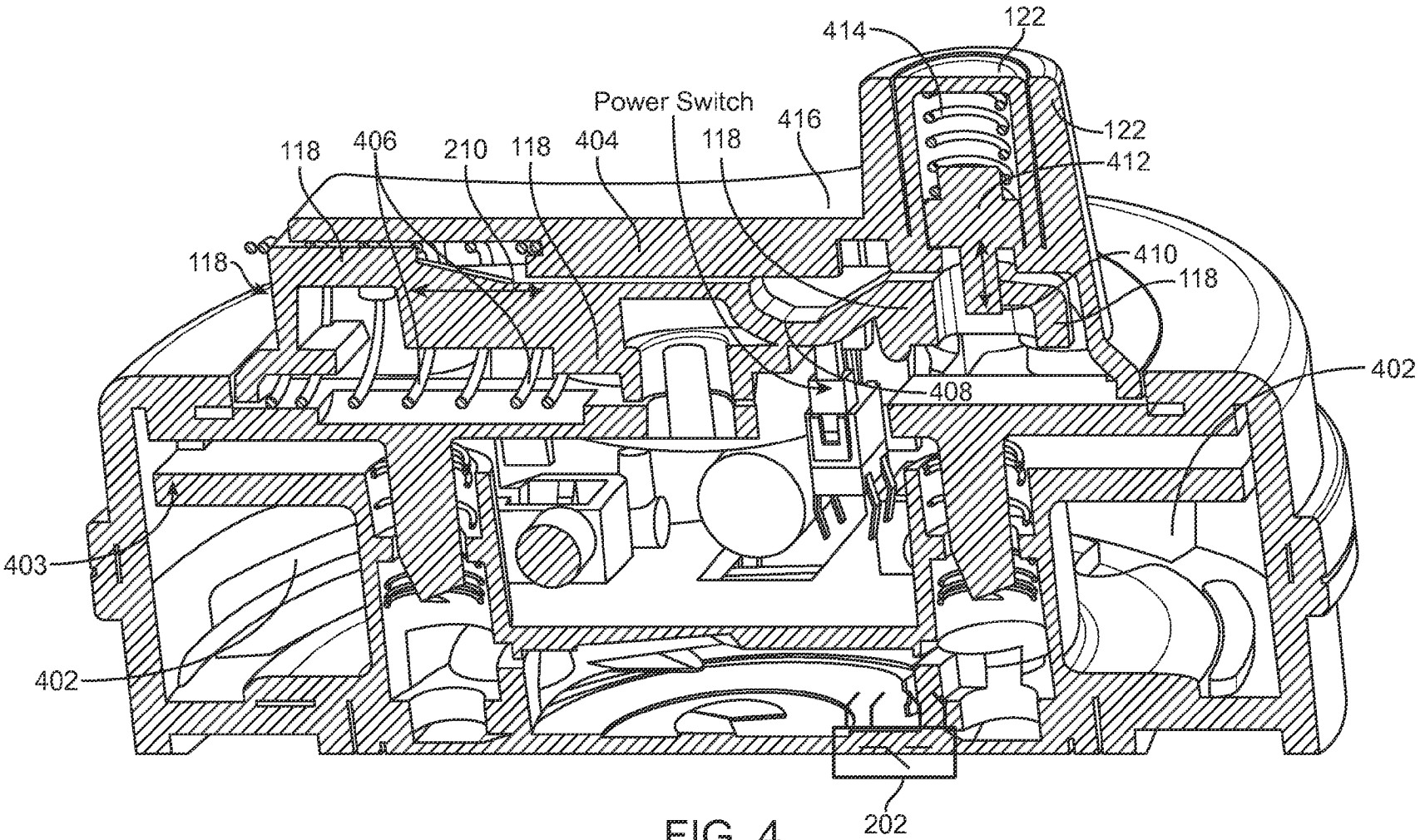
FIG. 4 is a non-limiting, exemplary illustration of the internal structure and mechanical functions of the components within the main member of the theft-deterrent tag illustrated in FIGS. 1A to 3C.

FIG. 4 is a non-limiting, exemplary illustration of the internal structure and mechanical functions of the main member 104 in accordance with the present invention. As illustrated, a reel mechanism is accommodated within the main member 104, and may comprise of a revolving spool with a handle 120. The spool body has a space 402 that accommodates a majority portion of the adjustable piece 116 when it reels-in the adjustable piece 116, and includes an opening for insertion and interlocking of a first end of the adjustable piece. The reel mechanisms are well known, a non-limiting example of which is disclosed in U.S. Pat. No. 7,984,629 to Xiaobin, the entire disclosure of which is expressly incorporated by reference herein.

The power actuator switch 118 is comprised of an elongated body housed within the actuator housing 404, and includes a transversally oriented clutch aperture 410 at a distal end that accommodates a clutch 412 housed in the clutch housing 122 within the handle 120. Near clutch aperture 410, the power switch actuator 118 is curved, with a convex portion actuating a power switch plunger 416 to supply power to the internal alarm system. That is, when the power actuator switch 118 is moved along the reciprocating path 210 within the switch housing 404, the clutch 412 locks the actuator switch 118 in the active (or closed) position, against the push of the biasing mechanism 406. The clutch 412, which is biased by its own biasing mechanism 414, contacts the "upper" edge of the actuator switch 118, and is eventually released into the transversally oriented clutch aperture 410 to lock the actuator switch 118 in its active (or closed) position, against the biasing mechanism 414. Accordingly, the mechanical biasing and interlocking interplay between the various components generates a holding strength for the power switching actuator 118 that is increased under tensile forces that attempt to separate them from their interlocking positions. As further illustrated, the actuator switch 118 further includes the curved section 408, the convex section of which actuates a power plunger switch 416, which supplies power to the internal alarm system. Accordingly, the actuation switch 118 activates the power switch to power the alarm system of the tag 100, and maintains the activations as a result of the action (or interlocking) of the clutch 412.

A magnetic detacher may be used to release and pull back the clutch 412 from its biased position, and out and away from the transversally oriented clutch aperture 410. This releases the actuator switch 118 (by the force of the basing mechanism 406), with the biasing mechanism 406 pushing the actuator switch 118 to its open position along the path 210, which shuts power to the alarm device. That is, the movement of the actuator switch 118 along the path 210 to an open position will move the curved section 408 away from the power switch plunger 416, releasing the plunger to an open position to cutoff power to the internal alarm system. The unlock movement of the actuator switch 118 would also deactivate the alarm. As stated above, the main member 104 accommodates a an alarm switch 202 that actuates upon securing the article within the coupling mechanism 110. That is, the alarm switch 202 is actuated when the article is inserted within the "clips" and the body of the article is pressed against the alarm switch 202. Actuation of the alarm switch 202 sets the alarm of the alarm system.

Figure 5A:
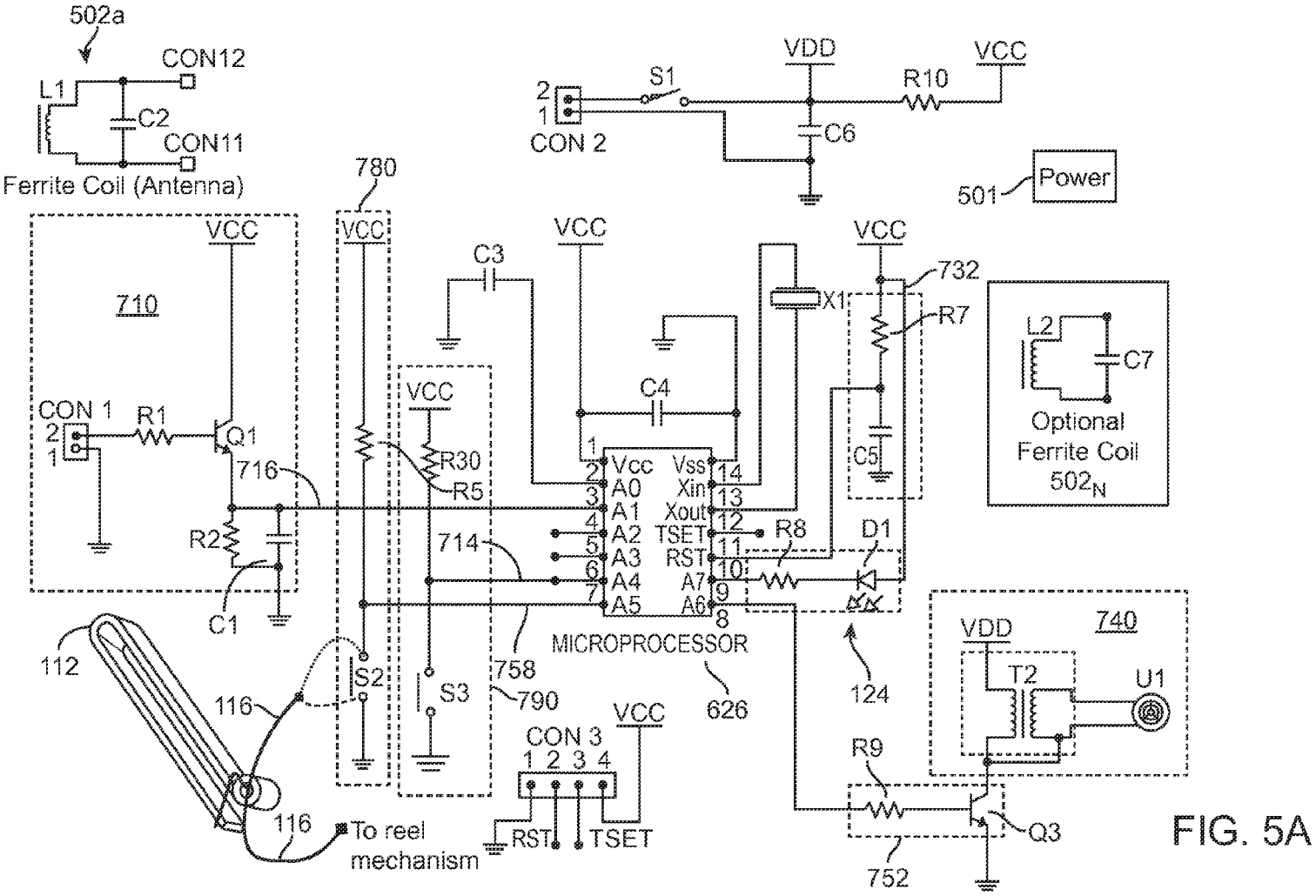
FIGS. 5A to 5C are non-limiting, exemplary illustrations of circuit schematics and topography of the alarm system of the theft-deterrent tag illustrated in FIGS. 1A to 4.
Figure 5B:
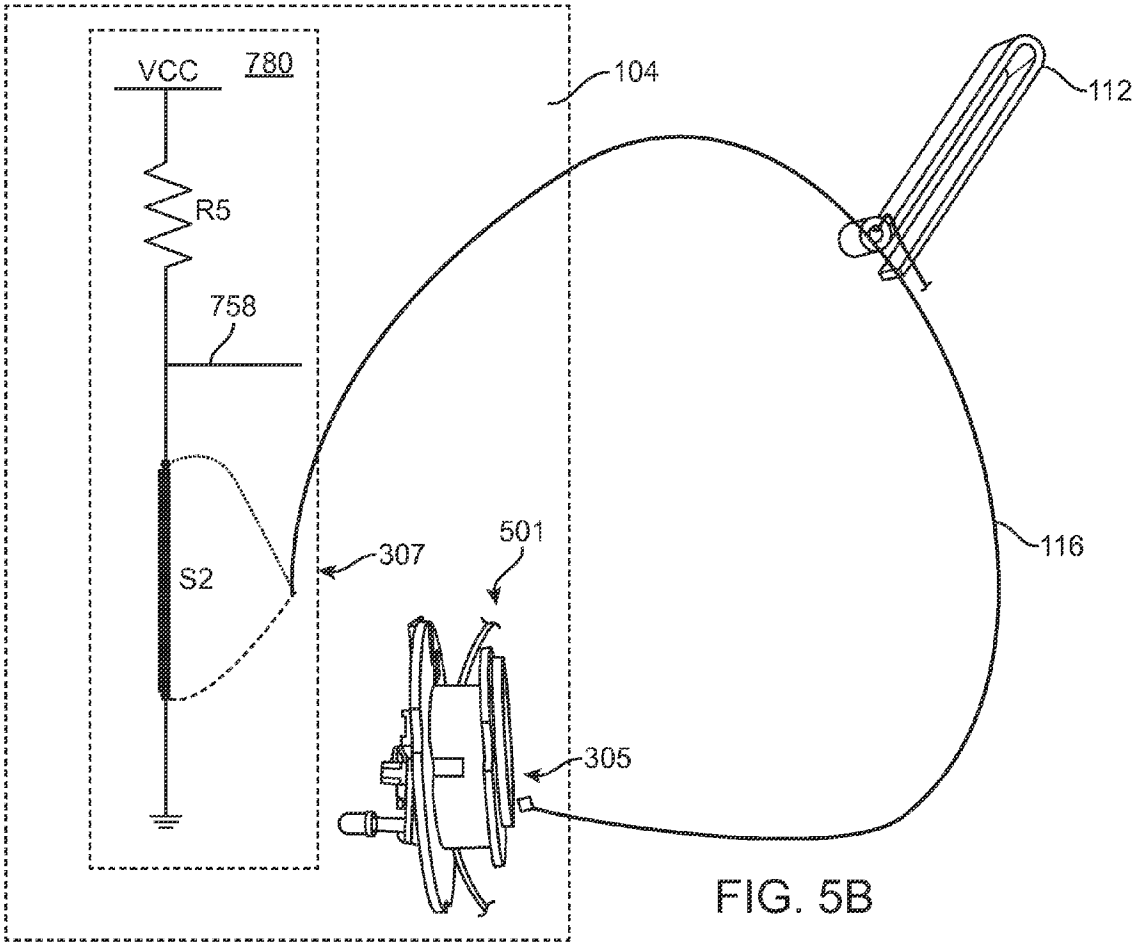
Figure 5C:
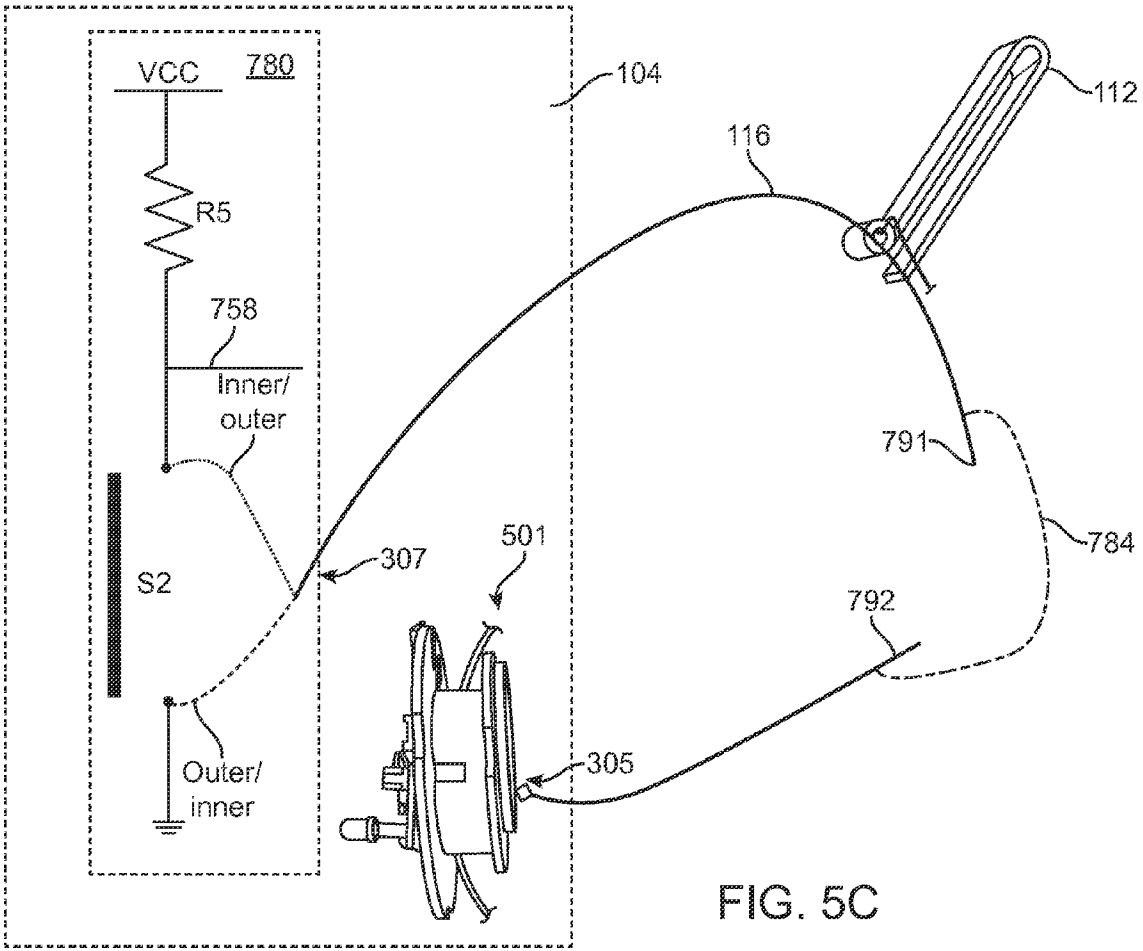

FIGS. 5A to 5C are exemplary illustrations of accommodations for the power and alarm system within the main member of the theft-deterrent tag, including exemplary illustration of the circuit schematics illustrating the circuit topography of the alarm system in accordance with the present invention. As illustrated, the tag 100 includes a plurality of independent mechanical and electrical circuitry that function to protect an article with which the tag 100 is coupled for protection. A first module in an exemplary form of a power switch 416 has associated with it a first independent mechanical and electrical circuitry that powers the tag 100 via switch 51. A second module in the form of the exemplary adjustable piece 116 has associated with it a second independent mechanical and electrical circuitry that enables a trigger of an alarm in case of tampering. A third module in the form of the exemplary arming mechanism 202 has associated with it a third independent mechanical and electrical circuitry that sets (or arms) the alarm tag and triggers an alarm in case of tampering. Finally, a fourth module in the exemplary form of one or more transponders 502*a*, 502*b*, . . . 502$_N$ that are associated with a fourth independent mechanical and electrical circuitry (e.g., connector CON 2) that receive or send signals, and trigger an alarm in case of an unauthorized removal of an article from a secure surveillance zone.

As illustrated in FIG. 5A to 5C, power is supplied to the power connector CON2 via a power source such as battery 501, and switched ON by the switch S1, providing the power Vcc to the circuit. The switch S1 is a schematic representation of the power plunger switch 416 of FIG. 4. As described in relation to FIG. 4, the power actuator switch 118 actuates the power plunger switch 416, which enables supply of power to the alarm system of the tag 100 shown in FIG. 5A. Therefore, when switch S1 in FIG. 5A (or power plunger switch 416 of FIG. 4) is closed, VCC power is supplied to the various components of the alarm circuit shown in FIG. 5A, with the power filtered through the capacitor and resistor combination C6 and R10.

In FIG. 5A, the dashed-line box indicated as reference 790 generally represents the alarm switch 202 of FIG. 4 and its interconnections with the alarm system of the theft-deterrent tag 100, and the dashed-line box indicated as reference 780 generally represents the adjustable piece 116 and its interconnections with the alarm system of the theft-deterrent tag 100.

As stated above, the main member 104 accommodates an alarm switch 202 that actuates upon securing the article within the coupling mechanism 110. That is, the alarm switch 202 is actuated when a portion of the article is inserted within the "clips" and the body of the article is pressed against the alarm switch 202 that is protruded from the main member 104. Actuation of the alarm switch 202 sets the alarm of the alarm system. Therefore, the switch S3 closes upon securing the article within the coupling mechanism 110. When the switch S3 is closed by the push of the article within the coupling mechanism 110, the output of the switch S3 is pulled low or ground and set to "0" from a high VCC via the current limiting resistor R30, and inputted to a first input line 714 of one or more input lines of a microprocessor 626 for activation (or arming) of the alarm tag 100. In general, output of the various modules pulled low or ground and set to "0" instruct the microprocessor 626 to arm the alarm. Therefore, when fully closed, the power switch S1 enables supply of power from the power source to the alarm system, and the output of the alarm switch S3 pulled low and set to "0" instructs the microprocessor 626 to arm the alarm.

As stated above, the dashed-line box indicated as reference 780 generally represents the adjustable piece 116 and its interconnections with the alarm system of the theft-deterrent tag 100. As further illustrated in FIG. 5A and described in detail above, the second distal end 307 of the adjustable piece 116 is coupled with the PCB, which is schematically represented by the switch S2 for better understanding. The switch S2 is virtual and is for illustrative purposes only. Switch S2 is used only to represent the open and closed circuit conditions of the adjustable piece 116 when the lanyard 116 has a complete loop (e.g., switch S2 is closed) or when it is severed (e.g., switch S2 is opened). Therefore, the illustrated switch S2 is not real, but is a mere representation of open or closed condition of the lanyard 116 closed loop circuit. Accordingly, the normal representation of this virtual "switch S2" is in its closed position (as shown in FIG. 5B) as soon as the second distal ends 307 of the inner and outer conductors are permanently connected to the input line 758 of the microprocessor 626 via the Printed Circuit Board (PCB). Therefore, the closed switch S2 represents a complete, internally short-circuited, electrically closed-circuit loop of the lanyard 116 at its first distal ends 305 (encapsulated within spool as shown, and within the main member 104), with its second distal ends 307 connected to the PCB (also within main member 104), with one of the conductors connected to the microprocessor 626 (via line 758) and the other connected to the ground GND. When the switch S2 is closed (e.g., the first distal ends 305 of the insulated inner and insulated outer conductors are electrically and mechanically connected together and the second distal ends 307 of the cable are mechanically and electrically connected to the input line 758 of the microprocessor 626 via the mechanical connection to the PCB and the ground), the output of the final connection (or the symbolically representative closed switch S2 shown in FIG. 5B) is pulled low and set to "0" via the current limiting resistor R5, and inputted to the input line 758 of one or more input lines of a microprocessor 626 for activation (or arming) of the alarm device of the alarm tag 100. With this configuration, the adjustable piece 116 is permanently connected to the reel mechanism of the main member at its first end, looped through the loop barrel 204 of the second coupling mechanism 112, and permanently connected with the microprocessor at its second end. Accordingly, in normal conditions (activated alarm or not), the virtual switch S2 will always remain closed as shown in FIG. 5B. However, as best illustrated in FIG. 5C, if the lanyard 116 is severed to release an article, even the use of jumper cables 784 will not prevent the sounding of an alarm. That is, jumper cable 784 may maintain the electrical circuit loop closed for the outer conductor only, but not the insulated inner conductor that is within and inside the outer conductor, and insulated from the outer conductor by a dielectric layer. That is, the jumper 784 may be mechanically and electrically connected to the severed ends of the 791 and 792 of the outer conductor, with the inner conductor severed and insulated from the outer conductor and the jumper 784. Therefore, when severing the lanyard 116 to disconnect and discontinue the physical loop to remove the secured article, the inner conductor will remain open circuited (symbolically represented as the open switch S2) when lanyard 116 is cut even if cable jumpers 784 are used. The open circuit condition (symbolically represented as the open switch S2) will pull the input line 758 to a high ("1"), which, in turn, will trigger the alarm.

Referring back to FIG. 5A, the alarm system of tag 100 further includes the general purpose microprocessor 626 mounted onto a PCB with an internal memory (e.g., an EEPROM) that includes a set of instructions. The microprocessor 626 receives one or more input signals from one or more input periphery devices and generates one or more processed output signals for actuation of one or more periphery output devices. The processing of data may include Analog to Digital (A/D) or D/A conversion of signals, and further, each input or pin of the microprocessor 626 may be coupled with various multiplexers to enable processing of several multiple input signals from different input periphery devices with similar processing requirements. Non-limiting examples of one or more input periphery devices may exemplarily include the power switch S1, the lanyard 116, the arming mechanisms S3, and the one or more transponders 502*a* to 502$_N$. Non-limiting examples of one or more output periphery devices may exemplarily include the use of vibration mechanisms, audio, visual or any other indicators to alarm and notify a user regarding an occurrence.

As exemplarily illustrated in FIG. 5A, the alarm tag 100 may use a first module in the form of the electronic article surveillance (EAS) tag 502*a* coupled with an EAS connector CON 1, with the EAS tag 502*a* comprised of a ferrite coil antenna that includes an inductor L1 and a capacitor C2. It should be noted that several transponder antennas 502*a* to 502$_N$ may be used, with each tuned to a different resonant frequency for activation of different types of pedestals, such as AM, RF, etc.

As illustrated, a first output of the EAS connector CON 11 is coupled with ground, and a second output of the EAS connector CON 12 is coupled with an amplifier 710 to generate an amplified signal from the EAS tag 502*a*. The amplifier 710 increases the signal strength from the EAS tag 502*a* sufficiently for further processing by the alarming circuit. The amplifier 710 is comprised of a current limiting resistor R1 that limits the current input to the base of the transistor Q1, with the transistor Q1 functioning to amplify the signal from EAS connector CON 1. The transistor Q1 is comprised of an exemplary NPN Bipolar Junction Transistor (BJT), with the collector coupled to power supply Vcc and the emitter coupled to ground via a resistor-capacitor filter. It should be noted that present invention should not be limited to the amplifier illustrated, and other conventional amplifiers may also be used. Further, the amplification need not be performed by the BJT, but can be done by other transistors, such as Metal Oxide Semiconductors (MOS) or MOS field effect transistors (MOSFETS), operational amplifiers, transformers, or the like, other passive or active devices, or any combination thereof.

The output of the EAS tag is amplified by the amplifier 710, and the amplified signal (form the emitter of the transistor Q1) is input to the microprocessor 626 via the input line 716 as one of one or more input signals, where the microprocessor 626 converts the analog amplified signal into a digital signal for processing. This signal is translated by the instructions (algorithm) within the EEPROM of the microprocessor 626 to determine if the signal came from the transmitters (pedestals); if so, the microprocessor 626 will trigger the alarm (e.g., an audio and or visual indicator). It should be noted that one or more of the one or more processed output signals may be pulsed output signals on output line (pin 8) to one of the one or more periphery output devices, for example, for actuation of a transducer unit 740 to generate an audio alarm signal.

The transducer unit 740 is actuated by an amplified pulsed output signal that is output from the microprocessor 626 via line (pin 8), and further amplified by an output amplifier 752. The output amplifier 752 is comprised of a BJT transistor Q3 with an emitter coupled to ground, a collector coupled to a transformer T2 of the transducer 740, and a base that is coupled with a current limiting resistor R9. The transistor Q3 amplifies the pulsed output signal from line (pin 8) to alternately drive the transformer from high Vcc to ground and vice versa, with the transformed pulse driving a ceramic transducer 742 to generate an audible alarm. It should be noted that a software routine within the microprocessor generates this pulsed output, which is amplified by the transistor Q3. In addition to the generation of an audible alarm, as further illustrated, other output periphery devices may include the use of a visual indicator D1 that use LEDs 124 to notify users of an occurrence. The visual indicator D1 is coupled with line pin 9 of the microprocessor 626. As indicated above, other output periphery devices not illustrated may also easily be accommodated and connected with the microprocessor 626.

As further illustrated, pins 1 and 14 of the microprocessor 626 are coupled to Vcc and ground via a filter capacitor C4, which power the microprocessor 626. The microprocessor 626 is further coupled via its pin 2 to ground through another filter capacitor C3. The crystal X1 coupled to pin 13 is used to facilitate a clocking signal to the microprocessor 626. That is, it stabilizes the frequency of the clock in the microprocessor 626. Pins 10 and 11 are respectively for reset and test of the microprocessor 626, which is through a connector CON 3 that enables the testing and reset of the microprocessor 626. The testing and reset enable determination of signaling of the microprocessor 626, for example, to determine if the microprocessor 626 functions based on "0" or "1" input signal level to trigger a device. In this exemplary instance, the microprocessor 626 will trigger an output periphery device when the input is pulled to high (or "1"). For example, when the cable 102 is cut, the switch 782 is opened, pulling the line 758 to Vcc (high or "1"), which triggers an alarm. The reset pin 10 is coupled with the reset circuit 732, which includes a current limiting resistor 734 that is coupled at one end to Vcc and other end to a capacitor 736, with the other end of the capacitor 736 coupled to ground. The reset pin 10 is coupled with at the junction of the resistor 734 and capacitor 736.

Figure 6:
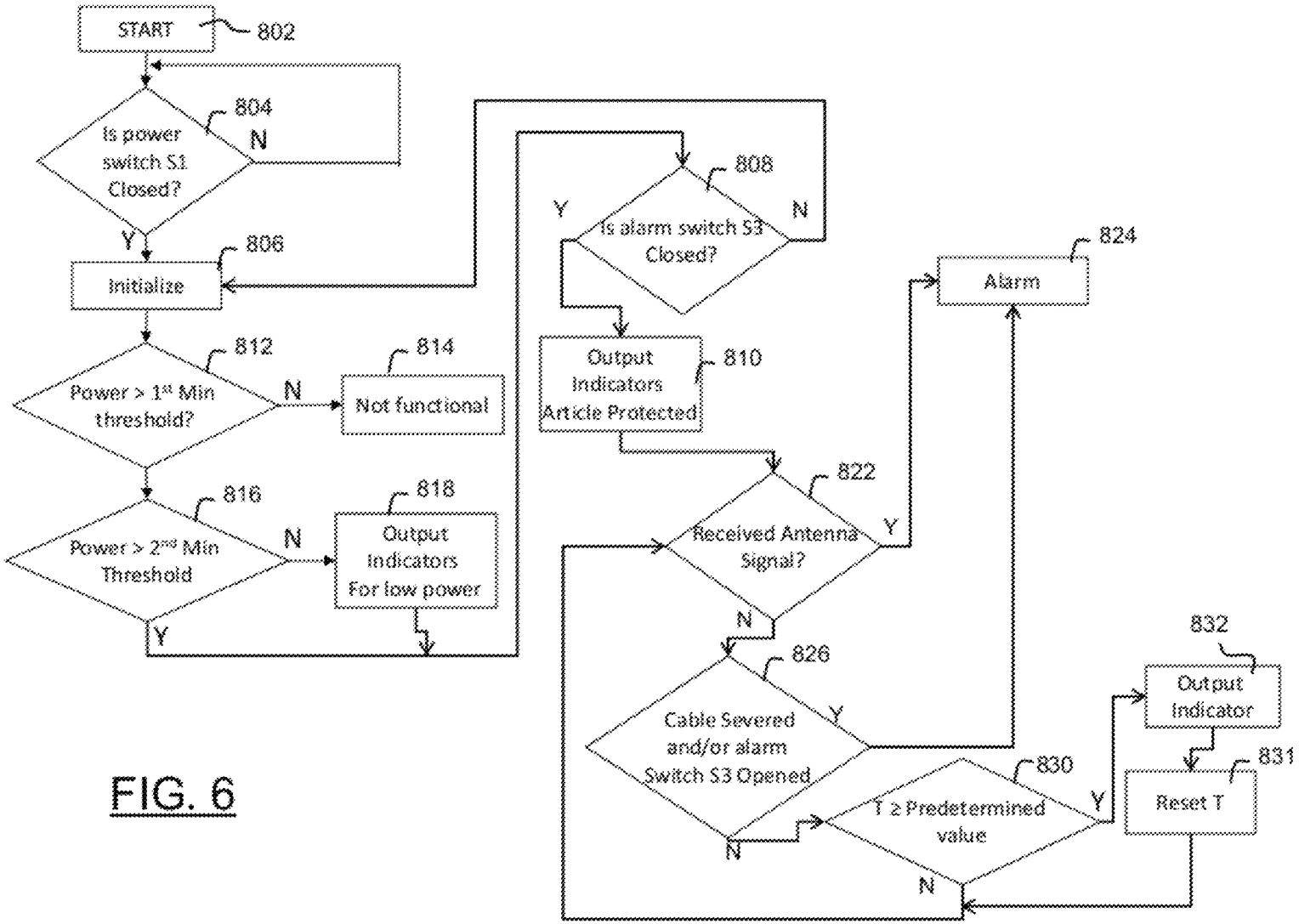
FIG. 6 is a non-limiting, exemplary flowchart, which illustrates the power management and functionality of a microprocessor of the theft-deterrent tag illustrated in FIGS. 1A to 5C.

FIG. 6 is an exemplary flowchart, which illustrates the power management and functionality of the microprocessor 626 for the alarm tag 100. As illustrated, upon start of the program at the operational functional act 802, the microprocessor 626 at the next operational functional act 804 determines if the power plunger switch S1 is closed. If the microprocessor 626 determines that the power plunger S1 is closed, then it initializes at the operational functional act 806, and at the operational functional act 812 the microprocessor 626 determiners if supplied power is greater than a first threshold level. If at the operational functional act 812 it is determined that supplied power is not greater than a first threshold level, the device is non-functional (operational functional act 814). Otherwise, if at the operational act 812 the microprocessor 626 determines that supplied power is greater than the first threshold, the microprocessor 626, at the operational functional act 816, determines if the supplied power is greater than a second threshold level, with the second threshold level greater than the first threshold level. If the microprocessor 626 determines that the supplied power is not greater than a second threshold level, the microprocessor 626 at the operational act 818 activates various output periphery units in certain manner to indicate low supply of power, but continues and activates the alarm to protect an article. If the microprocessor 626 determines that the supplied power is greater than the second threshold level, the microprocessor 626 at the operational functional act 808 determines if the alarm switch S3 is closed. If so, the alarm is set (or armed), and various indicators are activated to indicate to user that the article is protected (operational functional act 810). If the switch S3 is not closed, then initialization process 806 is repeated.

To continue with the flowchart of FIG. 6, the microprocessor 626 at the operational act 822 determines if an antenna signal is received by any one of one or more transponders 502*a* to 502$_N$. If the microprocessor 626 determines that such an antenna signal is received, at the operational act 824 the microprocessor 626 activates (or triggers) and sounds an alarm. A non-limiting example for such an alarm incident (or condition) is the actual removal of the article to which the alarm tag 100 is connected from a store, passing them through a surveillance zone. This will activate at least one of the one or more transponders 502*a* to 502$_N$ to trigger a signal, which will be amplified (via the amplifier 710) and input to the microprocessor 626 to activate (or trigger the alarm). If the microprocessor 626 determines that no such antenna signal was received, the microprocessor 626, at the operational functional act 826 determines if the lanyard 116 has been cut (or symbolically, the alarm plunger switch 603 is open). If the microprocessor 626 determines that the cable is cut and or the alarm plunger switch S3 is open, at the operational act 824 the microprocessor 626 activate (or triggers) the alarm, which indicates an actual tampering of the cable alarm tag 100. On the other hand, if the microprocessor 626 determines that the lanyard 102 is not cut (and symbolically, the alarm plunger switch S3 is still closed), at functional act 830 a determination is made regarding a timer to determine if a predetermined time has been reached. If at operational functional act 830 it is determined that a predetermined time has elapsed, an indicator is output and the timer is reset at operational functional act 831, where the microprocessor 626 then repeats operational functional act 812. The output indicator 832 is an audio and or visual indicator that enables a user to determine if the tag 100 is properly armed. The microprocessor 626 output a visual and or audio indicator periodically (while the tag 100 is armed) at specified predetermined time intervals T.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, instead of coupling the theft-deterrent tag 100 to a shoe, the same tag 100 may be detectably coupled with frame of a pricy artwork. Detachably mounting the theft-deterrent tag 100 onto an article 102 such as a frame of a painting would include positioning one of the first and the second coupling mechanisms 110 and 112 onto a first side of the frame, maneuvering the theft-deterrent tag 100 from behind the painting, and positioning the other of the second and first coupling mechanism 112 and 110 onto an opposite side of the frame (opposite the first coupling mechanism). The arrangement would enable the adjustable piece 116 to be routed via the back of the painting rather than from a front. Routing the adjustable piece along the back of the painting is beneficial in that the adjustable piece 116 will not obstruct the view of the painting (or be in the way thereof), enabling enjoyment of the painting without seeing the adjustable piece 116. Upon coupling the first and second coupling mechanism 110 and 112 with respective opposite sides of the frame, the handle 102 of the main member 104 is rotated to reel-in and contract the adjustable piece 116, which decreases the separation span between the main member 104 and the second coupling mechanism 112. The contraction of the adjustable piece 16 tightly secures with the theft-deterrent tag 100 onto the frame.

As another example of an alternative embodiment, the theft-deterrent tag 100 illustrated would be fully functional without the adjustable piece 116 and or the second coupling mechanism 112. That is, the theft-deterrent tag 100 may only comprise of the main member 104 and its connected coupling mechanism 110. Alternatively, the theft-deterrent tag 100 may only comprise of the main member 104, its coupling mechanism 110, and the adjustable piece 116. As still another example, the microprocessor 626 and the circuit topography illustrated in FIG. 5A may be designed so that the output of the various modules pulled high and set to "1" instruct the microprocessor 626 to arm the alarm. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A theft-deterrent tag, comprising:

a main member coupled with a wearable article by a coupling mechanism;

an alarm switch associated with the main member and the coupling mechanism;

the alarm switch is physically situated in an engagement path of the wearable article with the coupling mechanism;

the alarm switch is actuated to arm an alarm system by the wearable article contacting and pressing against the alarm switch while the wearable article travels the engagement path to fully engage with the coupling mechanism;

the alarm switch is actuated to trigger an alarm of the armed alarm system when the wearable article is removed from the coupling mechanism;

the coupling mechanism is configured to allow comfortable trial of the wearable article without detachment and removal of the theft deterrent tag from the wearable article and without damage to the wearable article; and an adjustable piece separate from the coupling mechanism that is looped around the wearable article and manipulated for a tight engagement of the main member with the coupling mechanism and the wearable article.

2. The theft-deterrent tag as set forth in claim 1, wherein:

the coupling mechanism is permanently attached and connected to the main member, and detachably secures the theft-deterrent tag with the wearable article for the detection of the wearable article.

3. The theft-deterrent tag as set forth in claim 1, wherein:

the coupling mechanism is comprised of a hardened material with insulation.

4. The theft-deterrent tag as set forth in claim 1, wherein:

the coupling mechanism is comprised of one of a clamp, clip, clasp, and U-clip.

5. The theft-deterrent tag as set forth in claim 1, wherein:

the coupling mechanism is mounted onto one of a Counter and Quarter sections of a shoe.

6. The theft-deterrent tag as set forth in claim 1, wherein:

the main member houses one or more transponders tuned to various frequencies that enable the theft-deterrent tag to function as an Electronic Article Surveillance (EAS) tag.

7. The theft-deterrent tag as set forth in claim 1, wherein:

the main member accommodates:

a reel;

a power source and electronics of the EAS tag; and the alarm switch.

8. The theft-deterrent tag as set forth in claim 7, wherein:

the alarm system includes one or more transponders tuned to various frequencies.

9. The theft-deterrent tag as set forth in claim 1, wherein:

the adjustable piece is a sense loop cable.

10. The theft-deterrent tag as set forth in claim 9, further comprising:

a second coupling mechanism coupled with the main member by the adjustable piece.

11. A theft-deterrent tag, comprising:

a main member that includes an alarm system and is coupled with a wearable article by a coupling mechanism;

the coupling mechanism is configured to allow comfortable trial of the wearable article without detachment and removal of the theft deterrent tag from the wearable article and without damage to the wearable article; and wherein the coupling mechanism includes:

a first coupling element that is permanently attached and physically connected to the main member, and detachably secures the theft-deterrent tar with the wearable article without damage to the wearable article;

a second coupling element that is separate from the main member and associated with an adjustable piece;

wherein the adjustable piece is separate from the coupling mechanism and is looped around the wearable article and manipulated for a tight engagement of the main member, including the first coupling element with the second coupling element and the wearable article.

12. The theft-deterrent tag as set forth in claim 11, further comprising:

an alarm switch associated with the main member and the first coupling element;

the alarm switch is physically situated in an engagement path of the wearable article with the first coupling element;

the alarm switch is actuated to arm an alarm system by the wearable article contacting and pressing against the alarm switch while the wearable article travels the engagement path to fully engage with the first coupling element;

the alarm switch is actuated to trigger an alarm of the alarm system when the wearable article is removed from the first coupling element.

13. The theft-deterrent tag as set forth in claim 11, wherein:

the main member includes a power switch actuator that, when actuated, actuates a power switch to supply power to the alarm system; and wherein the power switch actuator is held and maintained in an actuated state by a biasing mechanism.

14. The theft-deterrent tag as set forth in claim 11, wherein:

the main member houses one or more transponders tuned to various frequencies that enable the theft-deterrent tag to function as an Electronic Article Surveillance (EAS) tag.

15. The theft-deterrent tag as set forth in claim 11, wherein:

the alarm system is initialized when a power switch of the alarm system is switched to ON with the alarm system armed when an alarm switch is activated; and wherein, while the alarm system is armed, the alarm system triggers an alarm if:

an interrogation signal is received from a surveillance zone; or the wearable article is disengaged from the first coupling element; or the adjustable piece is severed, or any combination thereof.

16. The theft-deterrent tag as set forth in claim 11, wherein:

the adjustable piece is a sense loop cable, comprising:

an insulated inner conductor enclosed within and inside an insulated outer conductor.

17. The theft-deterrent tag as set forth in claim 16, wherein:

the insulated inner conductor is longitudinally insulated from the insulated outer conductor by a dielectric layer.

18. The theft-deterrent tag as set forth in claim 16, wherein:

a first distal end of the adjustable piece is encapsulated and is comprised of first ends of the insulated inner conductor and the insulated outer conductors; and a second distal end of the adjustable piece is comprised of second ends of the insulated inner conductor and the insulated outer conductors.

19. The theft-deterrent tag as set forth in claim 18, wherein:

the first ends of the insulated inner conductor and the insulated outer conductors are mechanically and electrically connected together, forming the first distal end of the adjustable piece; and the second ends of the insulated inner conductor and the insulated outer conductors are associated with the alarm system.

20. A theft-deterrent tag, comprising:

a main member that includes a transponder and is coupled with a wearable article by a coupling mechanism;

the coupling mechanism is configured to allow comfortable trial of the wearable article without detachment and removal of the theft deterrent tag from the wearable article and without damage to the wearable article; and wherein the coupling mechanism includes:

a first coupling element that is permanently attached and physically connected to the main member, and detachably secures the theft-deterrent tag with the wearable article;

a second coupling element that is separate from the main member and associated with an adjusting piece;

the adjusting piece being separate from the coupling mechanism and connected at both ends with the main member, looped around the article, and manipulated to adjust an extended length thereof for a tight engagement of the main member, including the first coupling element with the second coupling element and the wearable article.

21. The theft-deterrent tag as set forth in claim 20, wherein:

the adjusting piece is associated with a reel housed within the main member for winding in and extending out the extended length of the adjusting piece.

22. The theft-deterrent tag as set forth in claim 20, wherein:

the adjusting piece is a sense loop cable comprised of an insulated inner conductor enclosed within and inside an insulated outer conductor, with a first distal ends of the insulated inner conductor and the insulated outer conductor permanently connected together, both electrically and mechanically, and wherein second ends of the insulated inner conductor and the insulated outer conductor are coupled with an alarm system housed within the main member.

23. A theft-deterrent tag, comprising:

a main member that includes an alarm system and is coupled with a wearable article by a coupling mechanism;

the coupling mechanism is configured to allow comfortable trial of the wearable article without detachment and removal of the theft deterrent tag from the wearable article and without damage to the wearable article; and wherein the coupling mechanism includes:

a first coupling element that is permanently attached and physically connected to the main member, and detachably secures the theft-deterrent tag with the wearable article without damaging the wearable article;

a second coupling element that is separate from the main member and associated with a sense loop cable;

wherein the sense loop cable is separate from the coupling mechanism and is comprised of an insulated inner conductor enclosed within and inside an insulated outer conductor;

the sense loop cable having a distal end associated with the alarm system and being looped around the wearable article and manipulated for a tight engagement of the main member, including the first coupling element with the second coupling element and the wearable article.

24. The theft-deterrent tag as set forth in claim 23, wherein:

the sense loop cable includes another distal end where the insulated inner conductor and the insulated outer conductor are permanently connected together, both electrically and mechanically.

25. The theft-deterrent tag as set forth in claim 23, further comprising:

an alarm switch associated with the main member and the first coupling element;

the alarm switch is physically situated in an engagement path of the wearable article with the first coupling element; wherein the alarm switch is actuated to arm the alarm system by the wearable article contacting and pressing against the alarm switch while the wearable article travels the engagement path to fully engage with the first coupling element; and wherein the alarm switch is actuated to trigger an alarm of the alarm system when the wearable article is removed from the first coupling element.

* * * * *